US008360806B2

(12) United States Patent
Yi et al.

(10) Patent No.: US 8,360,806 B2
(45) Date of Patent: Jan. 29, 2013

(54) RF MODULE

(75) Inventors: Chong Hun Yi, Mechanicsburg, PA (US); Matthew R. McAlonis, Elizabethtown, PA (US); Stephen T. Morley, Manheim, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 182 days.

(21) Appl. No.: 12/976,095

(22) Filed: Dec. 22, 2010

(65) Prior Publication Data

US 2012/0164878 A1 Jun. 28, 2012

(51) Int. Cl.
*H01R 9/05* (2006.01)

(52) U.S. Cl. ..... 439/579; 439/638

(58) Field of Classification Search ..... 439/578, 439/579, 79, 638
See application file for complete search history.

(56) References Cited

U.S. PATENT DOCUMENTS

| | | | | |
|---|---|---|---|---|
| 7,690,944 | B2 * | 4/2010 | Matsumura et al. | 439/578 |
| 2003/0054689 | A1 * | 3/2003 | Johnsen et al. | 439/578 |
| 2007/0232146 | A1 * | 10/2007 | Yamakami | 439/638 |
| 2011/0217871 | A1 * | 9/2011 | Benham et al. | 439/583 |

* cited by examiner

*Primary Examiner* — Hien Vu

(57) ABSTRACT

An RF module configured to be coupled to a backplane module includes a front housing that has walls that define connector cavities. The walls include a rear wall that has a plurality of openings therethrough. The connector cavities are open opposite the rear wall to receive electrical connectors. The RF module also includes RF cable assemblies having front end connectors and rear end connectors that are connected by corresponding cables. The front and rear end connectors are coaxial connectors. The front end connectors are received in corresponding connector cavities through corresponding openings. The RF module includes a connector holder extending from the front housing rearward of the rear wall. The connector holder holds the rear end connectors such that the rear end connectors are simultaneously pluggable into corresponding board connectors of the backplane module.

18 Claims, 11 Drawing Sheets

RF MODULE

BACKGROUND OF THE INVENTION

The subject matter herein relates generally to electrical connector assemblies.

Due to their favorable electrical characteristics, coaxial cables and connectors have grown in popularity for interconnecting electronic devices and peripheral systems. The connectors include an inner conductor coaxially disposed within an outer conductor, with a dielectric material separating the inner and outer conductors. A typical application utilizing coaxial cable connectors is a radio-frequency (RF) application having RF connectors designed to work at radio frequencies in the UHF and/or VHF range.

Typically, one or more connectors are mounted to a circuit board of an electronic device at an input/output port of the device and extends through an exterior housing of the device for connection with a coaxial cable connector. Some systems include a plurality of connectors held in a common housing. One particular example of a system that uses multiple connectors is a backplane module having a plurality of board mounted connectors with a separate mating assembly for mating with a daughtercard module. The mating assembly includes a housing holding a plurality of coaxial cable connectors, which are connected to the board mounted connectors by a cable assembly having cable end connectors individually terminated to corresponding board mounted connectors. The daughtercard module is mated with the mating assembly.

Known backplane systems using RF connectors are not without disadvantages. For instance, each of the cable end connectors need to be individually and separately mated with the board connectors, which is time consuming and increases the cost of assembly. Additionally, the spacing between the housing of the mating assembly and the board connectors may be very small, such as less than one inch, making the assembly process difficult and time consuming. Having a large number of connections to make also increases the time and complexity.

A need remains for an RF module that may be mated with a backplane module in a cost effective, timely and reliable manner.

BRIEF DESCRIPTION OF THE INVENTION

In one embodiment, an RF module is provided that is configured to be coupled to a backplane module. The RF module includes a front housing that has walls that define connector cavities. The walls include a rear wall that has a plurality of openings therethrough. The connector cavities are open opposite the rear wall to receive electrical connectors. The RF module also includes RF cable assemblies having front end connectors and rear end connectors that are connected by corresponding cables. The front and rear end connectors are coaxial connectors. The front end connectors are received in corresponding connector cavities through corresponding openings. The RF module includes a connector holder extending from the front housing rearward of the rear wall. The connector holder holds the rear end connectors such that the rear end connectors are simultaneously pluggable into corresponding board connectors of the backplane module.

In another embodiment, an RF module is provided that is configured to be coupled to a backplane module. The RF module has a front housing that has a plurality of connector cavities and a rear wall that has a plurality of openings therethrough to corresponding connector cavities. The front housing has a base extending rearward from the rear wall. The RF module has cable assemblies having front end connectors and rear end connectors that are connected by corresponding cables. The front and rear end connectors are coaxial connectors. The front end connectors are received in corresponding connector cavities through corresponding openings. The rear end connectors have cable ends and mating ends with a flange therebetween. A connector holder is separately provided from, and coupled to, the base. The connector holder has a plurality of cylindrical bores that receive the cable ends of the rear end connectors. The mating ends of the rear end connectors extend rearward from the connector holders such that the mating ends of the rear end connectors are configured to be gang loaded into corresponding board connectors of the backplane module.

In a further embodiment, a board connector system is provided having a backplane module that includes a frame, a backplane circuit board held by the frame, and a plurality of board connectors that are terminated to the backplane circuit board. The board connector system also includes a daughtercard module having a housing and a plurality of electrical connectors held by the housing. The electrical connectors are one of board mounted connectors or cable mounted connectors. The board connector system also includes an RF module coupled to the frame and interconnecting the board connectors of the backplane module with corresponding electrical connectors of the daughtercard module. The RF module includes RF cable assemblies that have front end connectors and rear end connectors connected by corresponding cables. The front and rear end connectors are coaxial connectors. The front end connectors are connected to corresponding electrical connectors of the daughtercard module. The rear end connectors are connected to corresponding board connectors of the backplane module. The RF module further includes a front housing that has a plurality of connector cavities that receive and hold corresponding front end connectors. The RF module further includes a connector holder that has a plurality of cylindrical bores that receive the rear end connectors. The rear end connectors extend rearward from the connector holder such that the rear end connectors are configured to be gang loaded into corresponding board connectors of the backplane module.

DETAILED DESCRIPTION OF THE INVENTION

Figure 1:
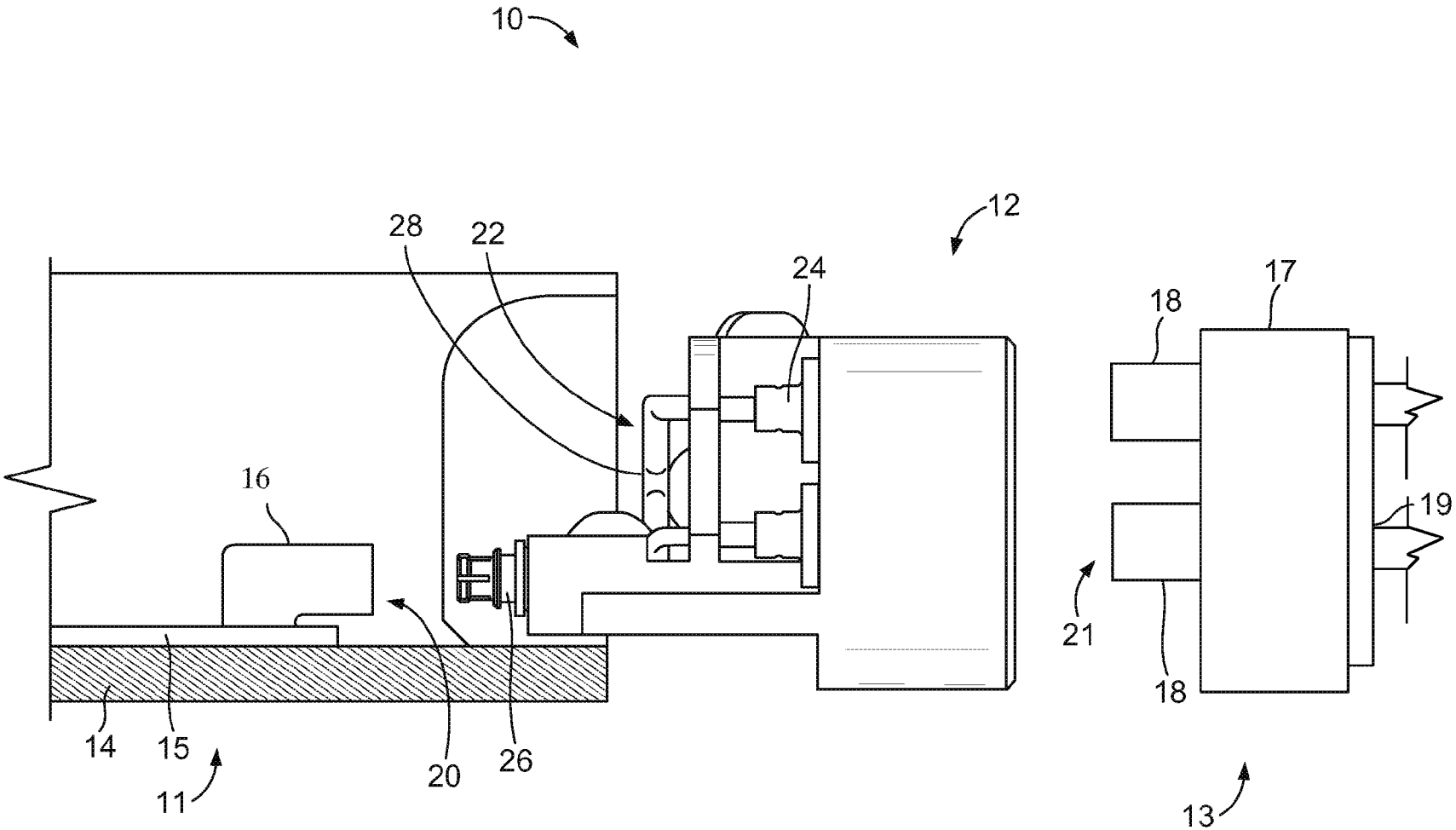
FIG. 1 illustrates an electrical connector system formed in accordance with an exemplary embodiment including a backplane module, an RF module and a daughtercard module.

FIG. 1 illustrates an electrical connector system 10 including a backplane module 11, an RF module 12 and a daughtercard module 13 formed in accordance with an exemplary embodiment. The electrical connector system 10 utilizes coaxial cables and coaxial connectors for interconnecting electronic devices and peripheral systems. While the electrical connector system 10 is illustrated and described as being used within a backplane system that uses the RF module 12 to interconnect the daughtercard module 13 with the backplane module 11, it is realized that the RF module 12 may be used in other applications to interconnect other devices or systems.

The RF module 12 is usable with any system that interconnects coaxial connectors and/or coaxial cables. The RF module 12 is particularly useful in systems that interconnect multiple coaxial connectors simultaneously. The electrical connector system 10 may be used within a rugged environment, such as in a military or aeronautical application in which the components of the electrical connector system 10 may be subject to vibration and/or shock. One particular application is use in a jammer system used for jamming other signals, such as cell phone signals or other wireless signals.

The backplane module 11 includes a frame 14, a backplane circuit board 15 held by the frame 14, and a plurality of board connectors 16 terminated to the backplane circuit board 15. The frame 14 may hold multiple backplane circuit boards 15. The board connectors 16 are coaxial connectors having an inner conductor (not shown) coaxially disposed within an outer conductor, with a dielectric material (not shown) separating the inner and outer conductors. The board connectors 16 may be SMP or SMPM type connectors, such as those commercially available from Tyco Electronics Ltd. Other types of connectors may be used in alternative embodiments.

In an exemplary embodiment, the board connectors 16 are receptacle connectors that receive jack connectors therein. The board connectors 16 may be smooth bore receptacle connectors or may be full detent receptacle connectors. The board connectors 16 may be right angle connectors or straight connectors terminated to the backplane circuit board 15. The board connectors 16 may be terminated to ends of cables rather than directly to the backplane circuit board 15 in alternative embodiments.

The daughtercard module 13 includes a housing 17 and a plurality of electrical connectors 18 held by the housing 17. Any number of electrical connectors 18 may be utilized depending on the particular application. The daughtercard module 13 includes a daughtercard circuit board 19, with the housing 17 mounted to the daughtercard circuit board 19. Alternatively, the daughtercard circuit board 19 may be held within the housing 17. The electrical connectors 18 are terminated to the daughtercard circuit board 19.

The electrical connectors 18 are coaxial connectors having an inner conductor (not shown) coaxially disposed within an outer conductor, with a dielectric material (not shown) separating the inner and outer conductors. The electrical connectors 18 may be SMP or SMPM type connectors or other types of connectors. The electrical connectors 18 are receptacle connectors that receive jack connectors therein. The electrical connectors 18 may be smooth bore receptacle connectors or may be full detent receptacle connectors. The electrical connectors 18 may be right angle connectors or straight connectors terminated to the daughtercard circuit board 19. In an alternative embodiment, the daughtercard module 13 may not include a daughtercard circuit board 19, but rather the electrical connectors 18 may be cable mounted connectors rather than board mounted connectors.

The RF module 12 is used to interconnect the board connectors 16 and the electrical connectors 18. The RF module 12 provides an interface to the backplane module 11 and the daughtercard module 13. In an exemplary embodiment, the backplane module 11 has a mating interface 20 (defined by the board connectors 16) and the daughtercard module 13 has a mating interface 21 (defined by the electrical connectors 18) that is different than the mating interface 20. As such, the daughtercard module 13 cannot be mated directly to the backplane module 11. In the illustrated embodiment, the electrical connectors 18 are grouped together in groups and provided in two rows, while the board connectors 16 are arranged in a single row, with each of the board connectors 16 being spaced apart by a common spacing distance. Other configurations are possible in alternative embodiments.

The RF module 12 includes a plurality of cable assemblies 22 having front end connectors 24 and rear end connectors 26, with cables 28 routed between corresponding front and rear end connectors 24, 26. The front and rear end connectors 24, 26 are coaxial connectors having an inner conductor (not shown) coaxially disposed within an outer conductor, with a dielectric material (not shown) separating the inner and outer conductors. The front and rear end connectors 24, 26 may be SMP or SMPM type connectors or other types of connectors. The front and rear end connectors 24, 26 are jack connectors configured to be received in receptacle connectors. The front and rear end connectors 24, 26 may be right angle connectors or straight connectors terminated to ends of the cables 28.

The front end connectors 24 are configured to be mated with the electrical connectors 18 of the daughtercard module 13. The rear end connectors 26 are configured to be mated with the board connectors 16 of the backplane module 11. In an exemplary embodiment, the electrical connectors 18 are held by the housing 17 and simultaneously mated to the RF module 12 such that all of the electrical connectors 18 are mated with the front end connectors 24 as the daughtercard module 13 is coupled to the RF module 12. In an exemplary embodiment, the rear end connectors 26 are held by the RF module 12 and simultaneously mated to the backplane module 11 such that all of the rear end connectors 26 are mated with the board connectors 16 as the RF module 12 is coupled to the backplane module 11. Having multiple connectors mated at the same time reduces the assembly time.

Figure 2:
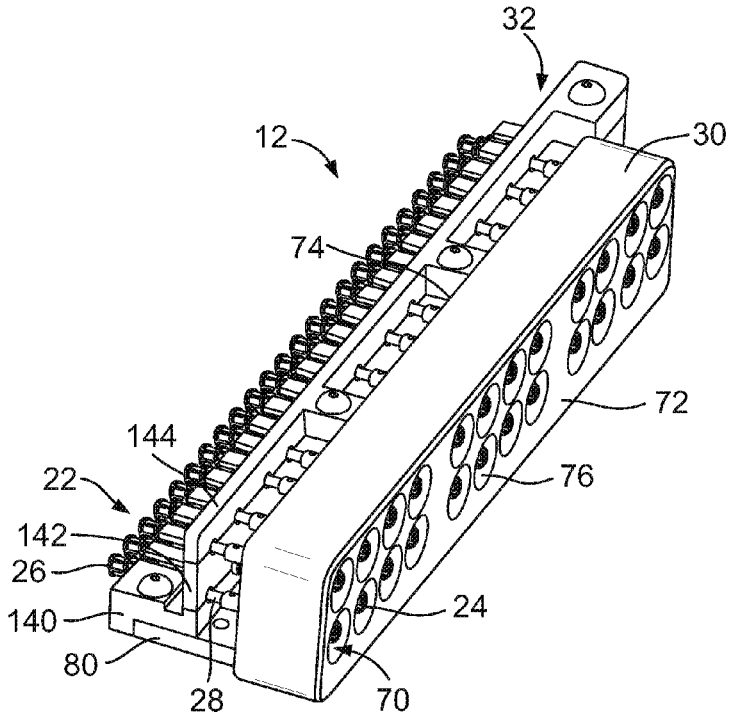
FIG. 2 is a front perspective view of the RF module shown in FIG. 1.
Figure 3:
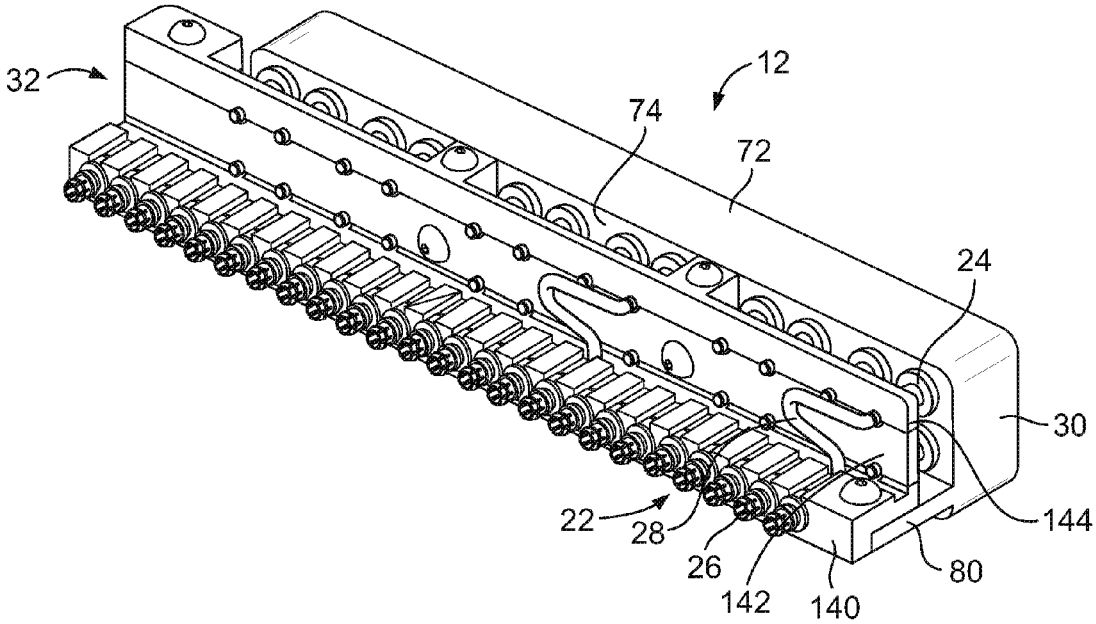
FIG. 3 is a rear perspective view of the RF module.

FIG. 2 is a front perspective view of the RF module 12. FIG. 3 is a rear perspective view of the RF module 12. The RF module 12 includes a front housing 30 that holds the front end connectors 24. The RF module 12 includes a connector holder 32 extending rearward from the front housing 30. The connector holder 32 holds the rear end connectors 26 such that the rear end connectors 26 may be simultaneously plugged into the board connectors 16 (shown in FIG. 1).

Figure 4:
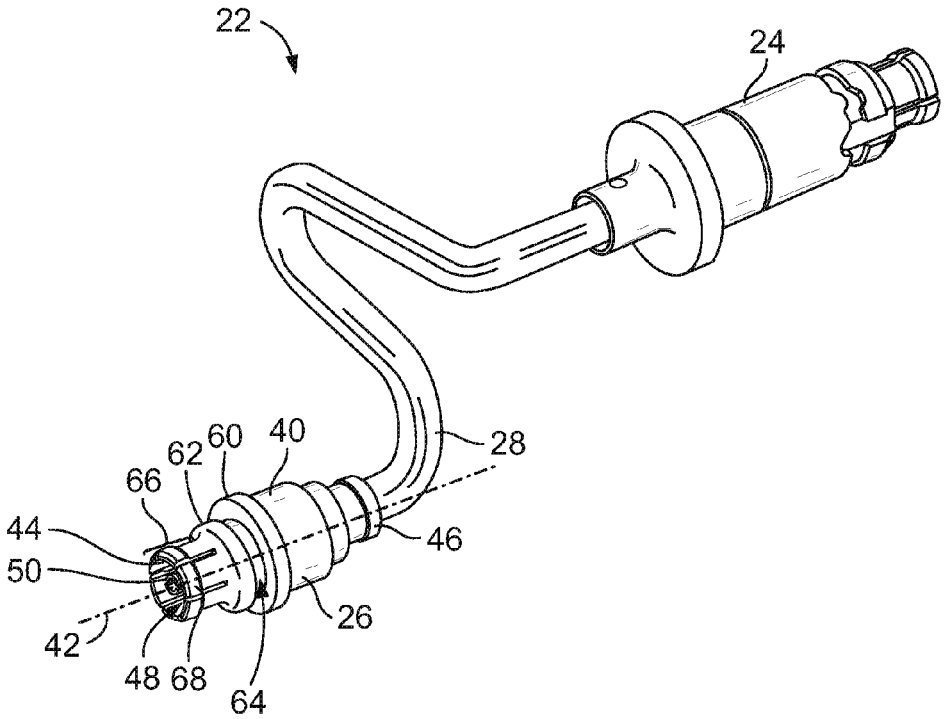
FIG. 4 illustrates a cable assembly for use with the RF module.

FIG. 4 illustrates one of the cable assemblies 22 for use with the RF module 12. The cable 28 extends between the front and rear end connectors 24, 26. The front and rear end connectors 24, 26 may be similar to one another, and the description hereafter generally refers to the rear end connector 26, it being realized that the front end connector 24 includes similar features.

The rear end connector 26 includes a shell 40 extending along a central longitudinal axis 42 between a mating end 44 and a cable end 46. The shell 40 defines a shell cavity 48. The rear end connector 26 includes a center contact 50 held within the shell cavity 48. In an exemplary embodiment, a dielectric body (not shown) is positioned between the shell 40 and the contact 50. In an exemplary embodiment, the shell 40 is formed from a conductive material, such as a metal material, and the dielectric body electrically separates the contact 50 and the shell 40. Optionally, a spring 54 (shown in FIG. 9) may concentrically surround a portion of the shell 40. The spring 54 is used to preload the rear end connector 26 against the connector holder 32 (shown in FIG. 2) or another structure. The front end connector 24 may also include a spring that is used to preload the front end connector 24 within the front housing 30 (shown in FIG. 2) for mating with the electrical connector 18 (shown in FIG. 1).

The shell 40 is cylindrical in shape. A front flange 60 extends radially outward from the shell 40. A rear flange 62 extends radially outward from the shell 40 rearward of the front flange 60. A gap 64 is defined between the front and rear flanges 60, 62.

The shell 40 is tapered or stepped at the mating end 44. The shell 40 includes a tip portion 66 configured to be received within the board connector 16. In an exemplary embodiment, the tip portion 66 includes a plurality of segments 68 that are flexible and movable with respect to one another, such as to secure the shell 40 within the receptacle defined by the board connector 16.

Returning to FIGS. 2 and 3, the front housing 30 includes a plurality of walls defining connector cavities 70. The front housing 30 extends between a mating end 72 and a rear wall 74 on a back side of the front housing 30. Some of the walls define interior walls 76 that separate adjacent connector cavities. Optionally, the connector cavities 70 may be cylindrical in shape. In the illustrated embodiment, the front housing 30 may be received in the frame 14 (shown in FIG. 1). Optionally, multiple RF modules 12 may be held proximate one another within the frame 14. The rear wall 74 includes a plurality of openings (not shown) therethrough that provide access to the connector cavities 70. The front end connectors 24 extend through the openings in the rear wall 74 into the connector cavities 70 for mating with the electrical connectors 18 (shown in FIG. 1). The front housing 30 includes a base 80 extending rearward from the rear wall 74. The base 80 is provided below the cable assemblies 22.

The connector holder 32 is separately provided from, and coupled to, the base 80 of the front housing 30. The connector holder 32 is used to hold the rear end connectors 26 for mating with the board connectors 16 of the backplane module 11. The connector holder 32 orients the rear end connectors 26 for gang loading the rear end connectors 26 into the board connectors 16 during assembly. In an exemplary embodiment, each of the rear end connectors 26 are arranged in a single row. The connector holder 32 holds the rear end connectors 26 such that the mating ends 72 are coplanar with one another for simultaneously loading the rear end connectors 26 into the board connectors 16. In an exemplary embodiment, the connector holder 32 defines a strain relief component for providing strain relief for the cables 28. For example, the cables 28 may be routed through the connector holder 32 to resist harmful movement of the cables 28 which would put undo stress or strain on the connection between the cables 28 and the front end connectors 24 and/or rear end connectors 26. The connector holder 32 may also orient the cables 28 in proper positions such that the front end connectors 24 and/or rear end connectors 26 are properly positioned for mating with the electrical connectors 18 and board connectors 16, respectively.

The connector holder 32 includes multiple pieces that may be coupled together and/or to the front housing 30. In the illustrated embodiment, the connector holder 32 includes a base holder 140, a central plate 142 and a top cover 144. The base holder 140 is coupled to the base 80. The base holder 140 holds the rear end connectors 26. The central plate 142 is coupled to the front housing 30 on top of the base holder 140. The cables 28 extending from the front end connectors 24 in the lower row extend between the base holder 140 and the central plate 142. The top cover 144 is coupled to the central plate 142 above the central plate 142. The cables 28 extending from the front end connectors 24 in the upper row are held between the central plate 142 and the top cover 144. The connector holder 32 may include other components in alternative embodiments. Optionally, the connector holder 32 may be provided without the top cover 144 and/or the central plate 142.

Figure 5:
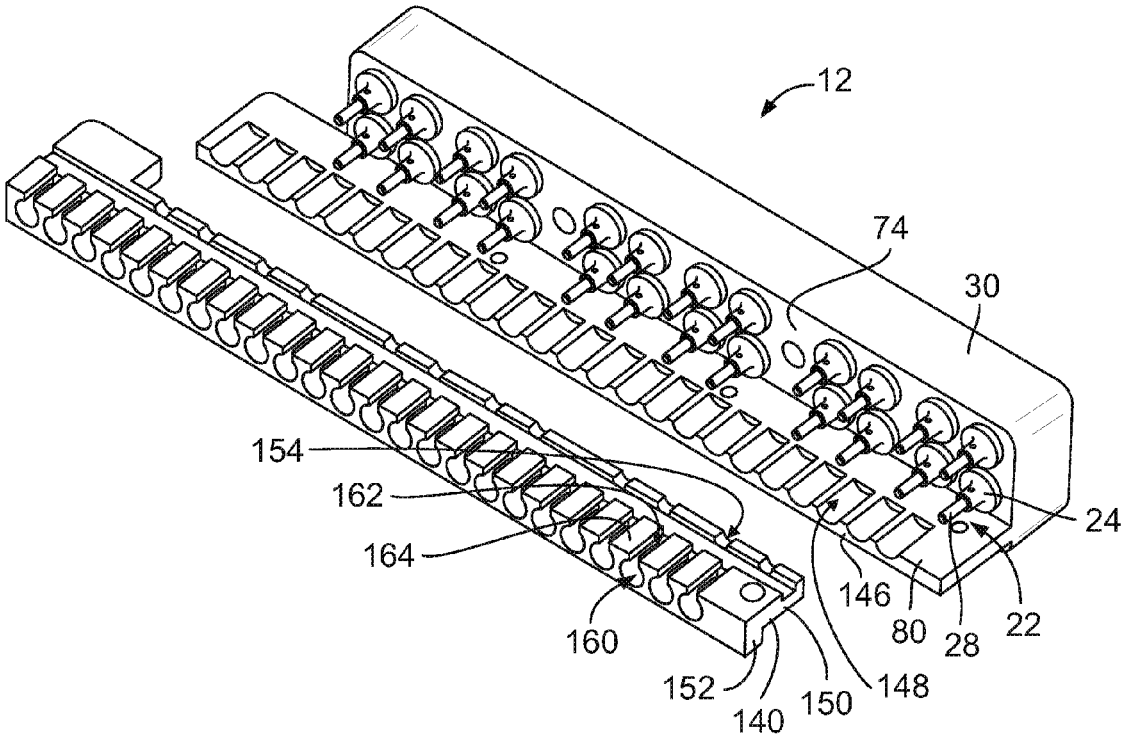
FIG. 5 is an exploded rear perspective view of a portion of the RF module.

FIG. 5 is an exploded rear perspective view of a portion of the RF module 12 showing the base holder 140 poised for mounting to the front housing 30. Portions of the cable assemblies 22, namely the rear end connectors 26 (shown in FIGS. 2 and 3), and portions of the cables 28 have been removed for clarity.

The base 80 includes a rear edge 146 and plurality of grooves 148 formed in the top surface thereof. The grooves 148 are configured to receive shells 40 (shown in FIG. 4) of corresponding rear end connectors 26.

The base holder 140 includes a plate 150 and a lip 152 at a rear of the plate 150. The lip 152 extends downward from the plate 150. The base holder 140 may be coupled to the base 80 such that the plate 150 rests on the top of the base 80 and the lip 152 extends along the rear edge 146. The plate 150 includes a plurality of pockets 154 at a front of the base holder 140. The pockets 154 are positioned to be aligned with the openings through the rear wall 74 of the front housing 30 associated with the lower row. The pockets 154 are configured to receive the cables 28 and provide a space for the cables 28 to pass through the connector holder 32. The pockets 154 support the cables 28 and the hold the cables 28 in position with respect to the openings in the rear wall 74. The pockets 154 resist side to side movement of the cables 28 to hold the cables 28 along longitudinal axes extending between the front end connectors 24 and the pockets 154.

The base holder 140 includes a plurality of cylindrical bores 160 formed in the plate 150 and the lip 152. The cylindrical bores 160 receive the rear end connectors 26. The cylindrical bores 160 are sized substantially the same as the shells 40 of the rear end connectors 26 such that the rear end connectors 26 can be held within the bores 160. The base holder 140 includes cable slots 162 along a top 164 of the corresponding bores 160. The cable slots 162 are open to the bores 160. In an exemplary embodiment, the cable slots 162 extend from the rear of the base holder 140 such that the cable slots 162 are open at the rear of the base holder 140. The cables 28 are configured to be received in the cable slots 162 such that the cables 28 may extend from above the base holder 140 into the bores 160. Optionally, the cables 28 may be moveable longitudinally within the cable slots 162, such as to allow shifting or moving of the rear end connectors 26 within the bores 160.

Figure 6:
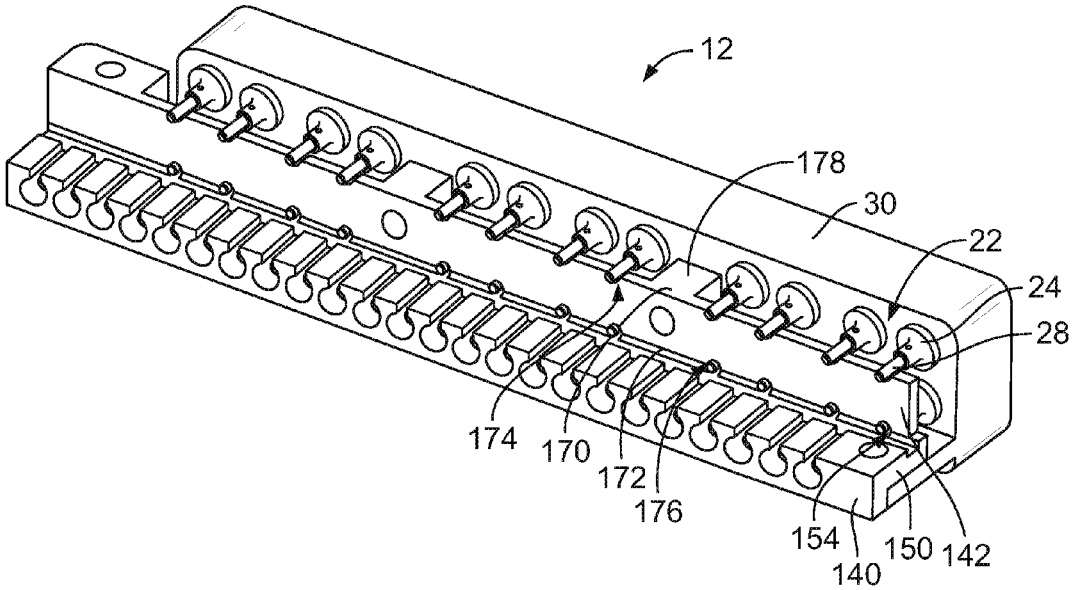
FIG. 6 is a rear perspective view of a portion of the RF module.

FIG. 6 is a rear perspective view of a portion of the RF module 12 showing the base holder 140 and the central plate 142 coupled to the front housing 30. Portions of the cable assemblies 22 have been removed for clarity. The central plate 142 is shown mounted on top of the base holder 140.

The central plate 142 includes a top 170 and a bottom 172. The central plate 142 has pockets 174 in the top 170 and pockets 176 in the bottom 172. The pockets 174 in the top 170 are aligned with the front end connectors 24 held in the upper row of the front housing 30. The pockets 176 in the bottom 172 are aligned with the front end connectors 24 held in the lower row of the front housing 30. The pockets 174, 176 receive the cables 28 extending from the front end connectors 24. The pockets 174, 176 resist side to side movement of the cables 28 and are configured to hold the cables 28 along longitudinal axes between the front end connectors 24 and the central plate 142. When the central plate is mounted above the base holder 140, the pockets 176 in the bottom 172 are aligned with the pockets 154 in the base holder 140. The pockets 154, 176 cooperate to circumferentially surround the cables 28 extending from the front end connectors 24 in the lower row. The bottom 172 may rest upon the top of the plate 150 at or proximate to the front of the base holder 140.

During assembly, the cable assemblies associated with the lower row are fished into the pockets 154 in the base holder 140. The central plate 142 is then mounted above the base holder 140 to capture the cables 28 within the pockets 154, 176. In the illustrated embodiment, the central plate 142 is mounted to the front housing 30 using mounting blocks 178 and fasteners (not shown) that secure the central plate 142 to the front housing 30. Alternatively, the central plate 142 may be secure to the base holder 140. The cable assemblies 22 in the upper row are then positioned over the top 170 of the central plate 142 such that the cables 28 rest in the pockets 174.

Figure 7:
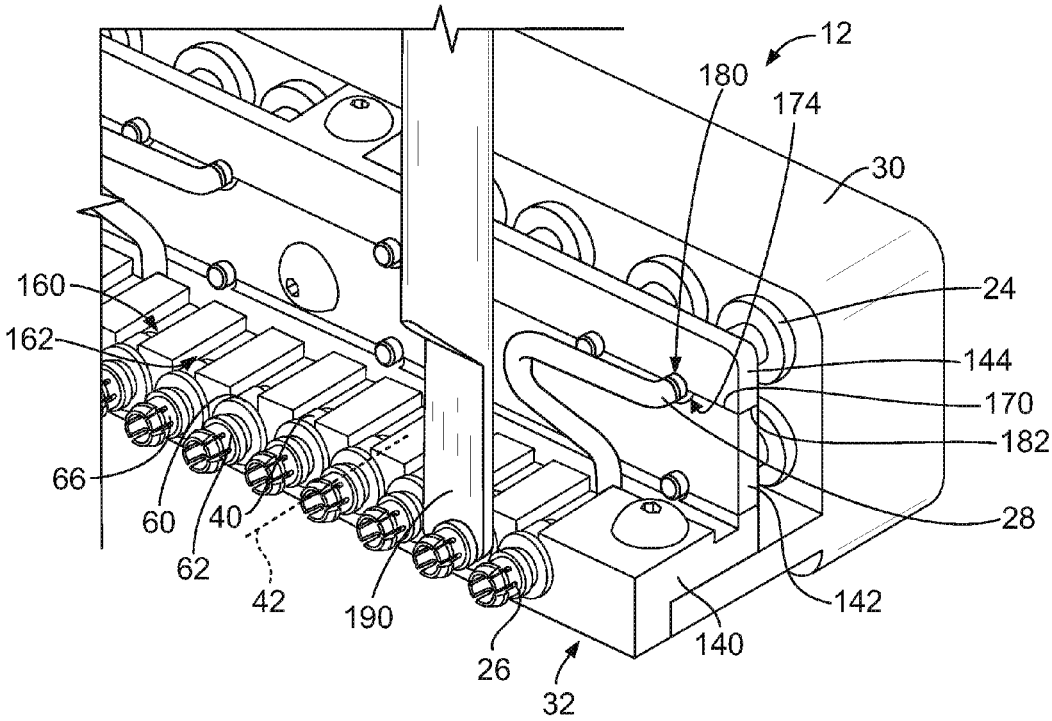
FIG. 7 is a rear perspective view of a portion of the RF module.

FIG. 7 is a rear perspective view of a portion of the RF module 12 showing the top cover 144 coupled to the central plate 142. The top cover 144 includes pockets 180 along a bottom 182 of the top cover 144. The top cover 144 is positioned over the central plate 142 such that the pockets 180 are aligned with the pockets 174 in the top 170 of the central plate 142. The cables 28 extending from the front end connectors 24 in the upper row extend through the pockets 180, 174. The top cover 144 and central plate 142 cooperate to hold the cables 28 therebetween.

When the cables 28 are held between the top cover 144 and central plate 142, and when the cables 28 are held between the central plate 142 and the base holder 140, the connector holder 32 provides strain relief for the cables 28, such as at the termination between the cables 28 and the front end connectors 24. The connector holder 32 holds the cables 28 along parallel longitudinal axes to prevent rotation or tilting of the front end connectors 24 within front housing 30.

The cables 28 extend through the connector holder 32 and are routed to the rear end connectors 26 through the cable slots 162. During assembly, the rear end connectors 26 are loaded into the cylindrical bores 160 through the rear end of the base holder 140. The cables 28 are fished into the cable slots 162 as the rear end connectors 26 are loaded into the bores 160. The rear end connectors 26 are loaded into the bores 160 until the front flanges 60 engage the rear end of the base holder 140. The rear end connectors 26 may be generally held within the bores 160 by an interference fit between the shells 40 and the bores 160. In an exemplary embodiment, the rear end connectors 26 are moveable within the bores 160 along the longitudinal axes 42 for mating with the board connector 16.

During mating, the RF module 12 is coupled to the back plane module 11 (shown in FIG. 1) such that the rear end connectors 26 are simultaneously loaded into the board connectors 16. In one embodiment, the board connectors 16 may define smooth bore receptacle connectors wherein the rear end connectors 26 may be mated with the board connectors 16 by simply pressing the rear end connectors 26 into the board connectors 16, wherein all of the rear end connectors 26 may be simultaneously mated to the board connectors 16.

In another embodiment, the board connectors 16 may define full detent receptacle connectors, wherein the rear end connectors 26 need to be snapped into the board connectors 16. The force required to mate all of the rear end connectors 26 to such board connectors 16 may be too high to overcome without damaging the components. In such situation, the rear end connectors 26 are initially loaded into the board connectors 16 during a gang loading process in which all of the rear end connectors 26 are simultaneously loaded into the board connectors 16 to an initial loaded position. A hand tool 190 may then be used to individually snap each of the rear end connectors 26 into the board connectors 16 by simply pressing the rear end connectors 26 in rearward direction. For example, the hand tool 190 may be placed between the front flange 60 and the rear flange 62. Rotating the hand tool 190 may press the rear end connector 26 in a rearward direction to snap the tip portion 66 into the board connector 16 until the tip portion 66 passes the detent in the board connector 16.

The connector holder 32 is used to align each of the rear end connectors 26 with the board connectors 16 such that the individual rear end connectors 26 do not need be positioned by hand during the assembly process. Rather, all of the rear end connectors 26 are initially loaded into the board connectors 16 and the rear end connectors 26 need to be moved along the longitudinal axes 42 only a short distance, such as less than 1 mm, to fully mate the rear end connector 26 to the board connector 16. Assembly using the hand tool 190 may be quick and easy, greatly reducing the assembly time as compared to systems in which the rear end connectors 26 must be individually handled and aligned with the corresponding board connectors 16 and then mated with the board connector 16 before moving on to the next rear end connector.

Figure 8:
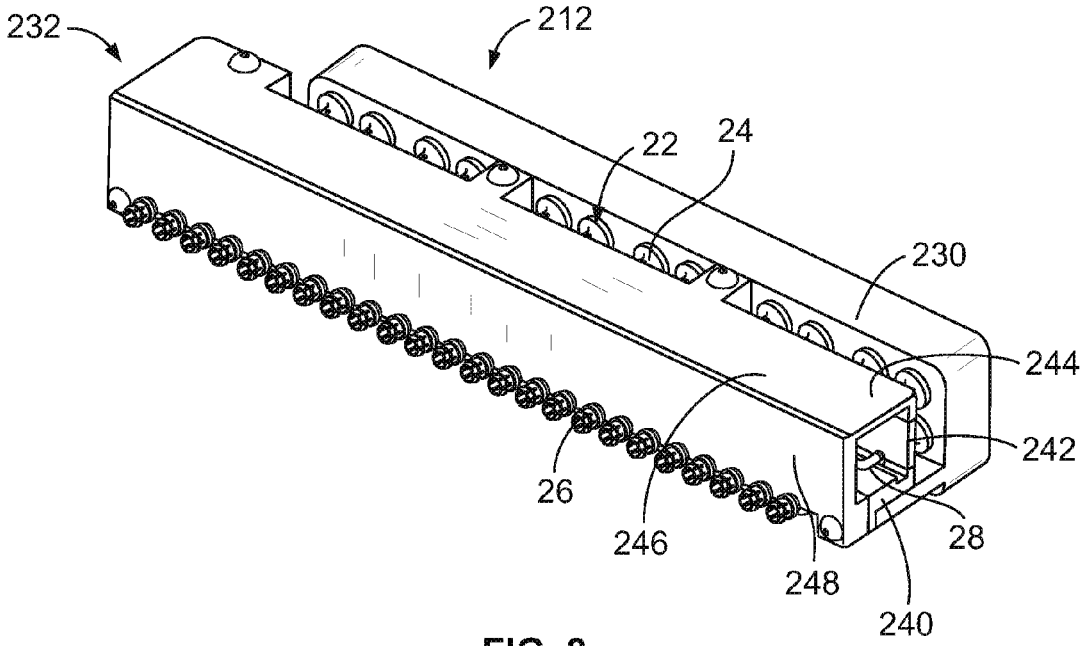
FIG. 8 is a rear perspective view of an alternative RF module.

FIG. 8 is a rear perspective view of an alternative RF module 212 that may be used to interconnect the backplane module 11 and the daughtercard module 13 (both shown in FIG. 1). The RF module 212 includes a front housing 230 that may be substantially similar to the front housing 30 (shown in FIG. 1). The RF module 212 holds a plurality of the cable assemblies 22. The front housing 230 holds the front end connectors 24 and a connector holder 232 holds the rear end connectors 26.

The connector holder 232 orients the rear end connectors 26 for gang loading the rear end connectors 26 into the board connectors 16 (shown in FIG. 1) during assembly. The connector holder 232 defines a strain relief component for providing strain relief for the cables 28. The connector holder 232 may also orient the cables 28 in proper positions such that the front end connectors 24 and/or rear end connectors 26 are properly positioned for mating with the electrical connectors 18 (shown in FIG. 1) and board connectors 16, respectively.

The connector holder 232 includes a base holder 240, a central plate 242 and a top cover 244. The base holder 240, central plate 242 and top cover 244 may be similar to the base holder 140, central plate 142 and top cover 144 (shown in FIG. 3).

The base holder 240 is coupled to the front housing 230 and holds the rear end connectors 26. The central plate 242 is coupled to the front housing 30 on top of the base holder 240. The top cover 244 is coupled to the central plate 242 above the central plate 242. The top cover 244 includes a top wall 246 and a rear wall 248 extending generally perpendicular to the top wall 246. The top wall 246 and rear wall 248 enclose the cable assemblies 22. The rear wall 248 engages the rear end connectors 26 at the base holder 240. The connector holder 232 may include other components in alternative embodiments. Optionally, the connector holder 232 may be provided without the top cover 244 and/or the central plate 242.

Figure 9:
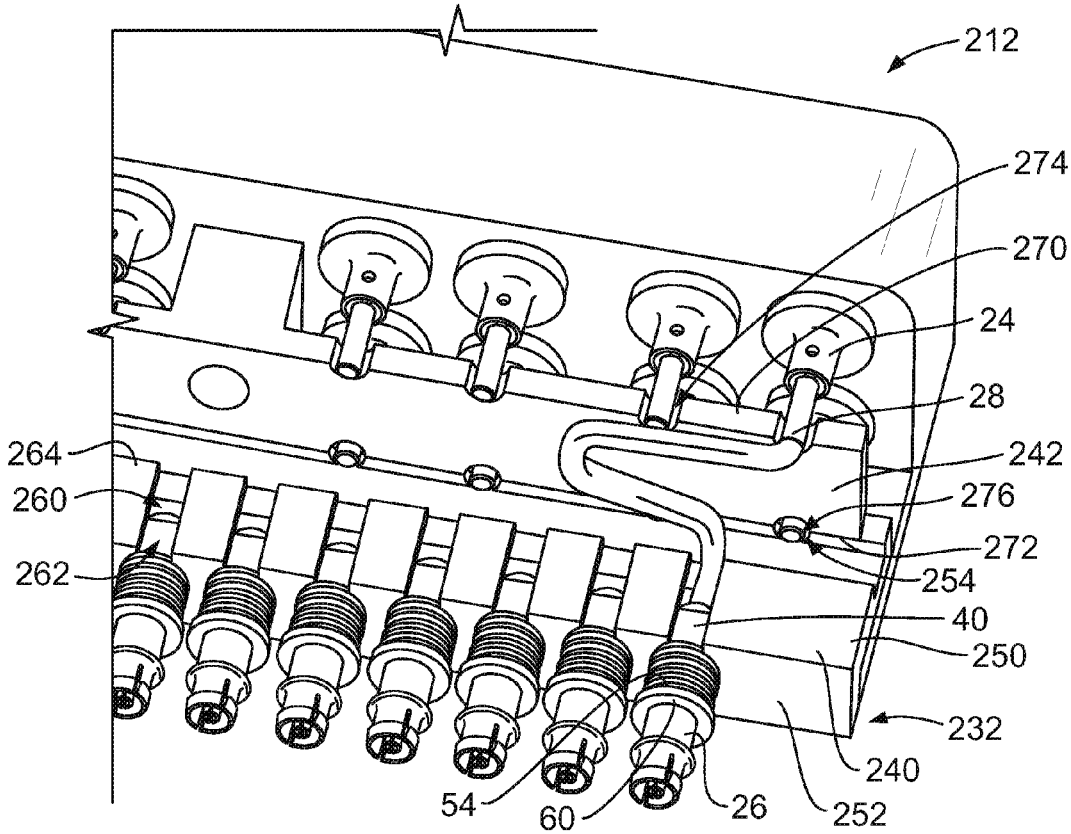
FIG. 9 is a rear perspective view of a portion of the RF module shown in FIG. 8.

FIG. 9 is a rear perspective view of a portion of the RF module 212. Only one cable 28 is illustrated extending entirely between the front end connector 24 and the rear end connector 26, while portions of the other cables have been removed for clarity. In the illustrated embodiment, the springs 54 surround the shells 40 of the rear end connectors 26. The springs 54 are positioned between the front flange 60 and the base holder 240. The springs 54 may be compressed during mating with the board connectors 16 (shown in FIG. 1). The springs 54 tend to force the rear end connectors 26 into the board connectors 16 to maintain connection therebetween.

The base holder 240 includes a plate 250 and a lip 252 at a rear of the plate 250. The lip 252 extends downward from the plate 250. The plate 250 includes a plurality of pockets 254 at a front of the base holder 240. The pockets 254 are configured to receive the cables 28 and provide a space for the cables 28 to pass through the connector holder 232.

The base holder 240 includes a plurality of cylindrical bores 260 formed in the plate 250 and the lip 252. The cylindrical bores 260 receive the rear end connectors 26. The base holder 240 includes cable slots 262 along a top 264 of the corresponding bores 260. The cable slots 262 are open to the bores 260. The cables 28 are configured to be received in the cable slots 262 such that the cables 28 may extend from above the base holder 240 into the bores 260. Optionally, the cables 28 may be moveable longitudinally within the cable slots 262, such as to allow shifting or moving of the rear end connectors 26 within the bores 260.

The central plate 242 is shown mounted on top of the base holder 240. The central plate 242 includes a top 270 and a bottom 272. The central plate 242 has pockets 274 in the top 270 and pockets 276 in the bottom 272. The pockets 274, 276 receive the cables 28 extending from the front end connectors 24 and rear end connectors 26, respectively.

Figure 10:
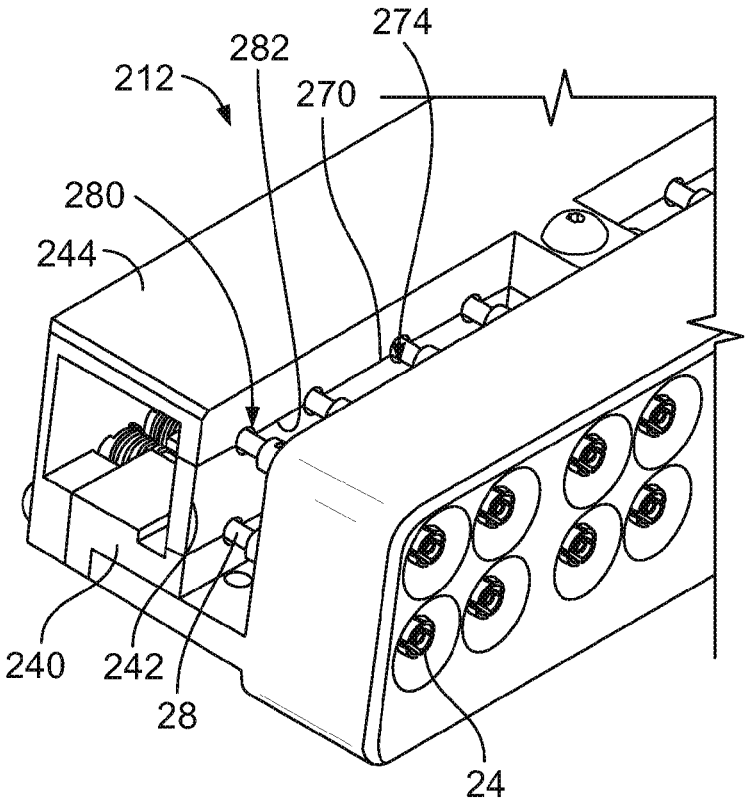
FIG. 10 is a front perspective view of a portion of the RF module shown in FIG. 8.

FIG. 10 is a front perspective view of a portion of the RF module 212 showing the top cover 244 coupled to the central plate 242 and/or the base holder 240. The top cover 244 includes pockets 280 along a bottom 282 of the top cover 244. The top cover 244 is positioned over the central plate 242 such that the pockets 280 are aligned with the pockets 274 in the top 270 of the central plate 242. The cables 28 extending from the front end connectors 24 in the upper row extend through the pockets 280, 274.

Figure 11:
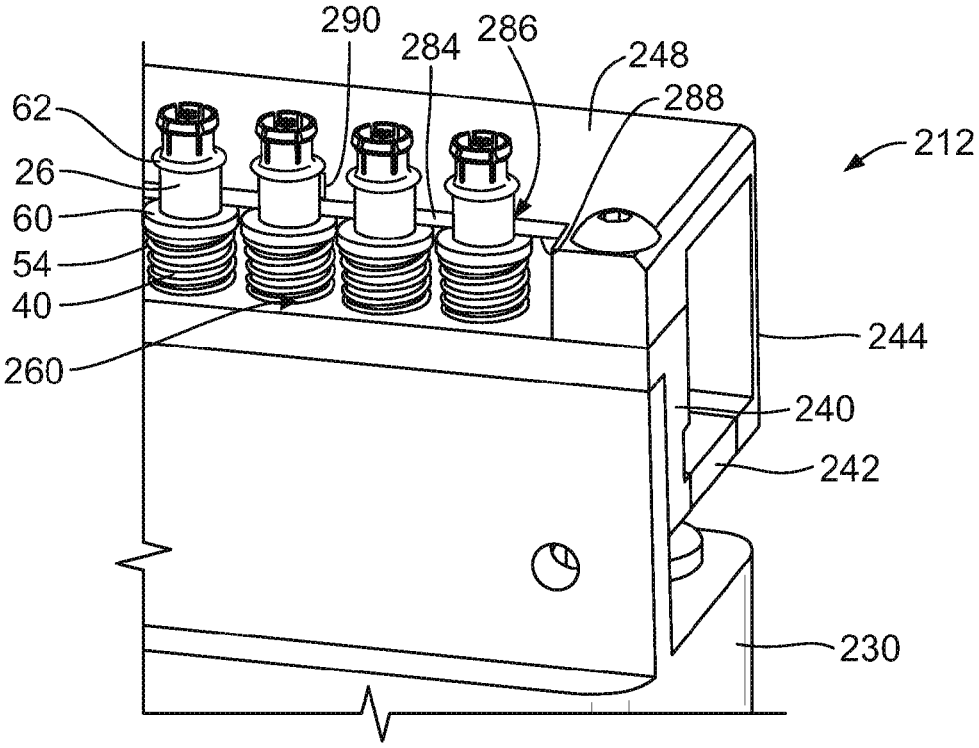
FIG. 11 is a bottom perspective view of a portion of the RF module shown in FIG. 8.

FIG. 11 is a bottom perspective view of a portion of the RF module 212. During assembly, the rear end connectors 26 are loaded into the cylindrical bores 260 through the rear end of the base holder 240. The springs 54 are positioned between the rear end of the base holder 240 and the front flange 60. The central plate 242 and top cover 244 are then positioned and secured to the base holder 240 and/or the front housing 230. The rear wall 248 extends to, and engages, the rear end connectors 26. A lower edge 284 of the rear wall 248 includes grooves 286 formed therein that are sized and shaped to receive the shells 40 of the rear end connectors 26. The front flanges 60 engage an inner surface 288 of the rear wall 248. Optionally, when the top cover 244 is coupled to the base holder 240, the springs 54 may be at least partially compressed to preload the springs 54 to be biased outward for mating with the board connectors 16.

The rear wall 248 is positioned between the front flange 60 and the rear flange 62. In an exemplary embodiment, a gap 290 is defined between the rear flange 62 and the rear wall 248. The gap 290 allows a predetermined amount of travel of the rear end connector 26 during mating with the board connector 16. For example, the gap 290 may be approximately 1.0 mm, which allows 1.0 mm of travel during mating with the board connector 16.

During mating, the RF module 212 is coupled to the back plane module 11 (shown in FIG. 1) such that the rear end connectors 26 are simultaneously loaded into the board connectors 16. In one embodiment, the board connectors 16 may define smooth bore receptacle connectors wherein the rear end connectors 26 may be mated with the board connectors 16 by simply pressing the rear end connectors 26 into the board connectors 16, wherein all of the rear end connectors 26 may be simultaneously mated to the board connectors 16. The springs 54 help push the rear end connectors 26 into the smooth bore board connectors 16. Assembly is quick and easy, greatly reducing the assembly time as compared to systems in which the rear end connectors 26 must be individually handled and aligned with the corresponding board connectors 16 and then mated with the board connector 16 before moving on to the next rear end connector.

Figure 12:
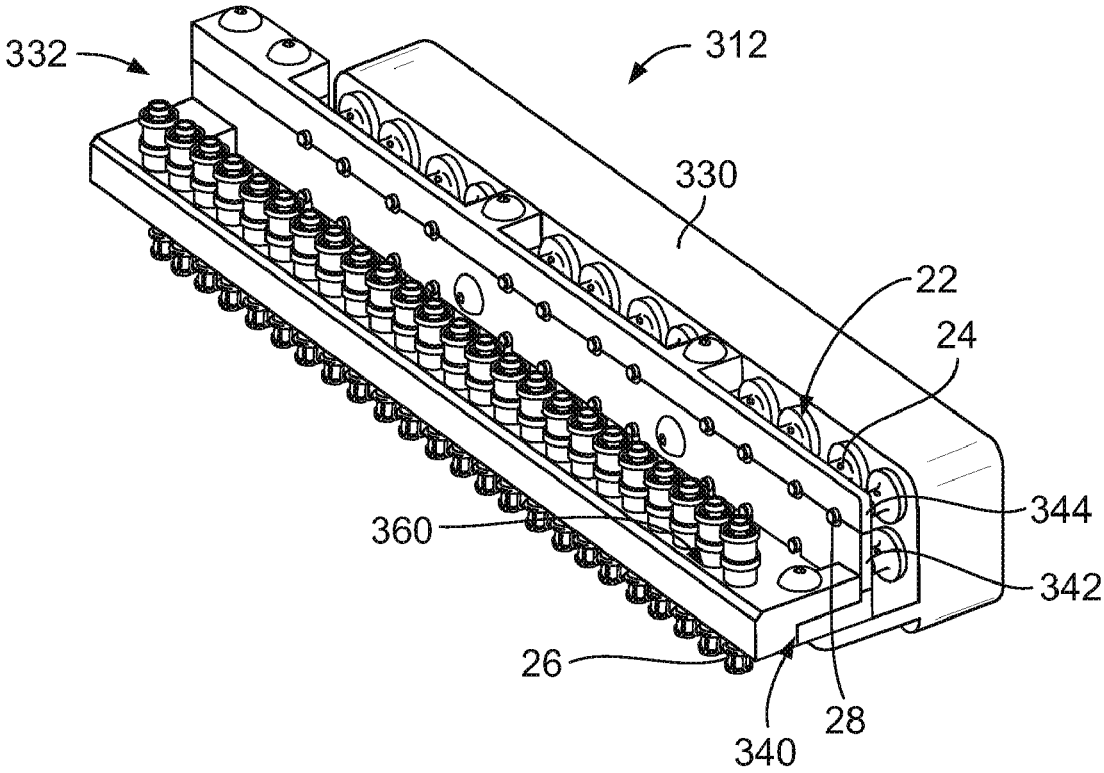
FIG. 12 is a rear perspective view of another alternative RF module.

FIG. 12 is a rear perspective view of an alternative RF module 312 that may be used to interconnect the backplane module 11 and the daughtercard module 13 (both shown in FIG. 1). The RF module 312 includes a front housing 330 that may be substantially similar to the front housing 30 (shown in FIG. 1). The RF module 312 holds a plurality of the cable assemblies 22, wherein portions of the cables 28 of the cable assemblies 22 have been removed for clarity. The front housing 330 holds the front end connectors 24 and a connector holder 332 holds the rear end connectors 26.

The connector holder 332 orients the rear end connectors 26 for gang loading the rear end connectors 26 into the board connectors 16 (shown in FIG. 1) during assembly. In the illustrated embodiment, the connector holder 332 orients the rear end connectors 26 generally perpendicular to the front end connectors 24. For example, if the front end connectors 24 are oriented horizontally then the rear end connectors 26 are oriented generally vertically. Other orientations are possible in alternative embodiments.

The connector holder 332 includes a base holder 340, a central plate 342 and a top cover 344. The base holder 340, central plate 342 and top cover 344 may be similar to the base holder 140, central plate 142 and top cover 144 (shown in FIG. 3). In the illustrated embodiment, the base holder 340 includes multiple pieces, such as an upper piece and a lower piece. The lower piece is mounted to the front housing 330 and the upper piece includes bores 360 that receive and hold the rear end connectors 26. Optionally, the rear end connectors 26 may be held in the bores 360 without any springs. The rear end connectors 26 may be initially gang loaded into the board connectors (shown in FIG. 1) and then snapped into final positions using the hand tool 190 (shown in FIG. 7).

Figure 13:
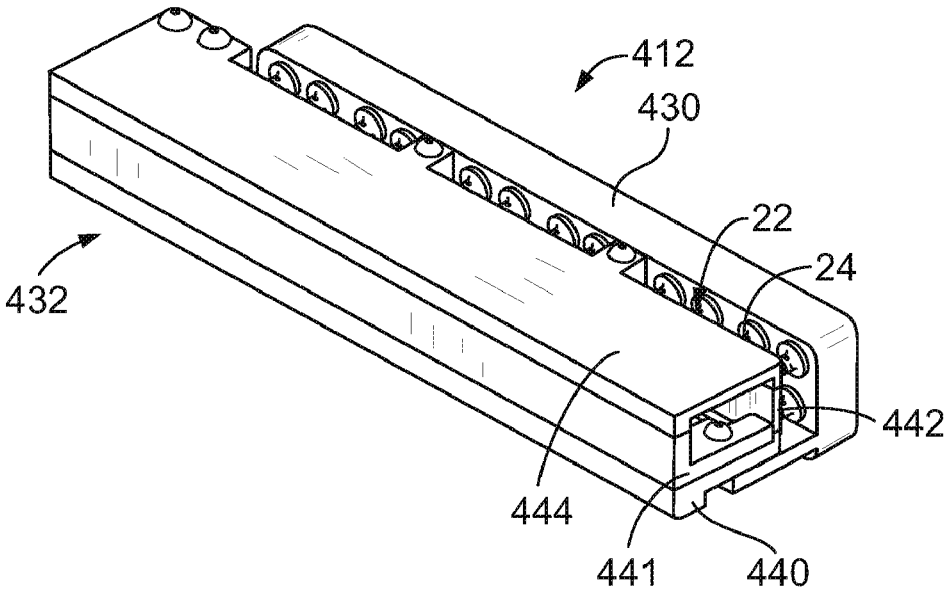
FIG. 13 is a rear perspective view of yet another alternative RF module.

FIG. 13 is a rear perspective view of an alternative RF module 412 that may be used to interconnect the backplane module 11 and the daughtercard module 13 (both shown in FIG. 1). The RF module 412 includes a front housing 430 that may be substantially similar to the front housing 30 (shown in FIG. 1). The RF module 412 holds a plurality of the cable assemblies 22. The front housing 430 holds the front end connectors 24 and a connector holder 432 holds the rear end connectors 26.

The connector holder 432 orients the rear end connectors 26 for gang loading the rear end connectors 26 into the board connectors 16 (shown in FIG. 1) during assembly. In the illustrated embodiment, the connector holder 432 orients the rear end connectors 26 generally perpendicular to the front end connectors 24. For example, if the front end connectors 24 are oriented horizontally then the rear end connectors 26 are oriented generally vertically. Other orientations are possible in alternative embodiments.

The connector holder 432 includes a lower base holder 440, an upper base holder 441, a central plate 442 and a top cover 444. The lower base holder 440 is coupled to the front housing 430. The upper base holder 441 is coupled to the lower base holder 440 and together the upper and lower base holders 440, 441 hold the rear end connectors 26. The central plate 442 is coupled to the front housing 430 on top of the lower base holder 440. The top cover 444 is coupled to the central plate 442 above the central plate 442. The top cover 444 rests on the upper base holder 441. The connector holder 432 may include other components in alternative embodiments. Optionally, the connector holder 432 may be provided without the top cover 444 and/or the central plate 442.

Figure 14:
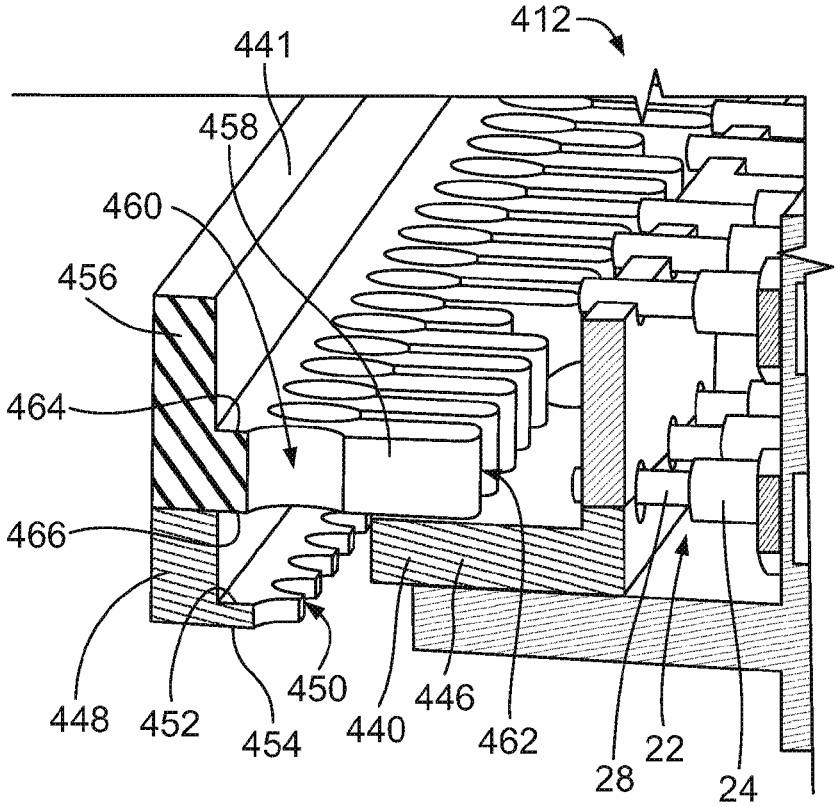
FIG. 14 is a sectional view of a cavity of the RF module shown in FIG. 13.

FIG. 14 is a sectional view of a portion of the RF module 412. Portions of the cable assemblies 22 have been removed for clarity. The lower base holder 440 includes a main body 446 and a lip 448 extending from the main body 446. The lip 448 includes a plurality of channels 450 that have an open front. The lip 448 has an inner surface 452 and an outer surface 454. The channels 450 are configured to receive the rear end connectors 26 therein.

The upper base holder 441 includes a main body 456 and a plurality of fingers 458 extending forward from the main body 456. The fingers 458 have cylindrical bores 460 therebetween with channels 462 forward of, and open to, the bores 460. The fingers 458 have an inner surface 464 and an outer surface 466. The bores 460 are configured to receive the rear end connectors 26 therein. The channels 462 provide a space for the cables 28 to be routed to the rear end connectors 26 from the central plate 442.

Figure 15:
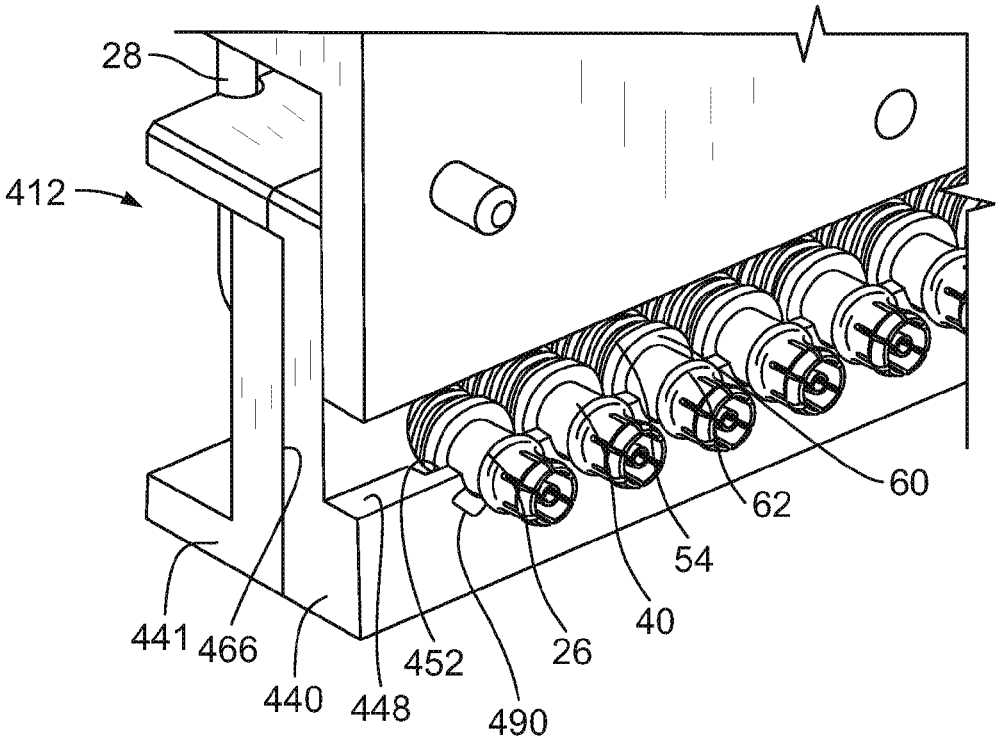
FIG. 15 is a bottom perspective view of a portion of the RF module shown in FIG. 13.

FIG. 15 is a bottom perspective view of a portion of the RF module 412. In the illustrated embodiment, the springs 54 surround the shells 40 of the rear end connectors 26. The springs 54 are positioned between the front flange 60 and the upper base holder 441. The springs 54 may be compressed during mating with the board connectors 16 (shown in FIG. 1). The springs 54 tend to force the rear end connectors 26 into the board connectors 16 to maintain connection therebetween.

During assembly, the rear end connectors 26 are loaded into the cylindrical bores 460 (shown in FIG. 14) through the bottom of the upper base holder 441. The cables 28 may be passed through the channels 462 (shown in FIG. 14) into the bores 460 and then the cable ends 46 (shown in FIG. 4) loaded through the bores 460. The springs 54 are positioned between the outer surface 466 of the upper base holder 441 and the front flange 60. The front flange 60 rests on the inner surface 452 of the lower base holder 440. Optionally, when the upper base holder 441 is coupled to the lower base holder 440, the springs 54 may be at least partially compressed to preload the springs 54 to be biased outward for mating with the board connectors 16.

The lip 448 is positioned between the front flange 60 and the rear flange 62. In an exemplary embodiment, a gap 490 is defined between the rear flange 62 and the lip 448. The gap 490 allows a predetermined amount of travel of the rear end connector 26 during mating with the board connector 16. For example, the gap 490 may be approximately 1.0 mm, which allows 1.0 mm of travel during mating with the board connector 16.

During mating, the RF module 412 is coupled to the back plane module 11 (shown in FIG. 1) such that the rear end connectors 26 are simultaneously loaded into the board connectors 16. In one embodiment, the board connectors 16 may define smooth bore receptacle connectors wherein the rear end connectors 26 may be mated with the board connectors 16 by simply pressing the rear end connectors 26 into the board connectors 16, wherein all of the rear end connectors 26 may be simultaneously mated to the board connectors 16. The springs 54 help push the rear end connectors 26 into the smooth bore board connectors 16. Assembly is quick and easy, greatly reducing the assembly time as compared to systems in which the rear end connectors 26 must be individually handled and aligned with the corresponding board connectors 16 and then mated with the board connector 16 before moving on to the next rear end connector.

Figure 16:
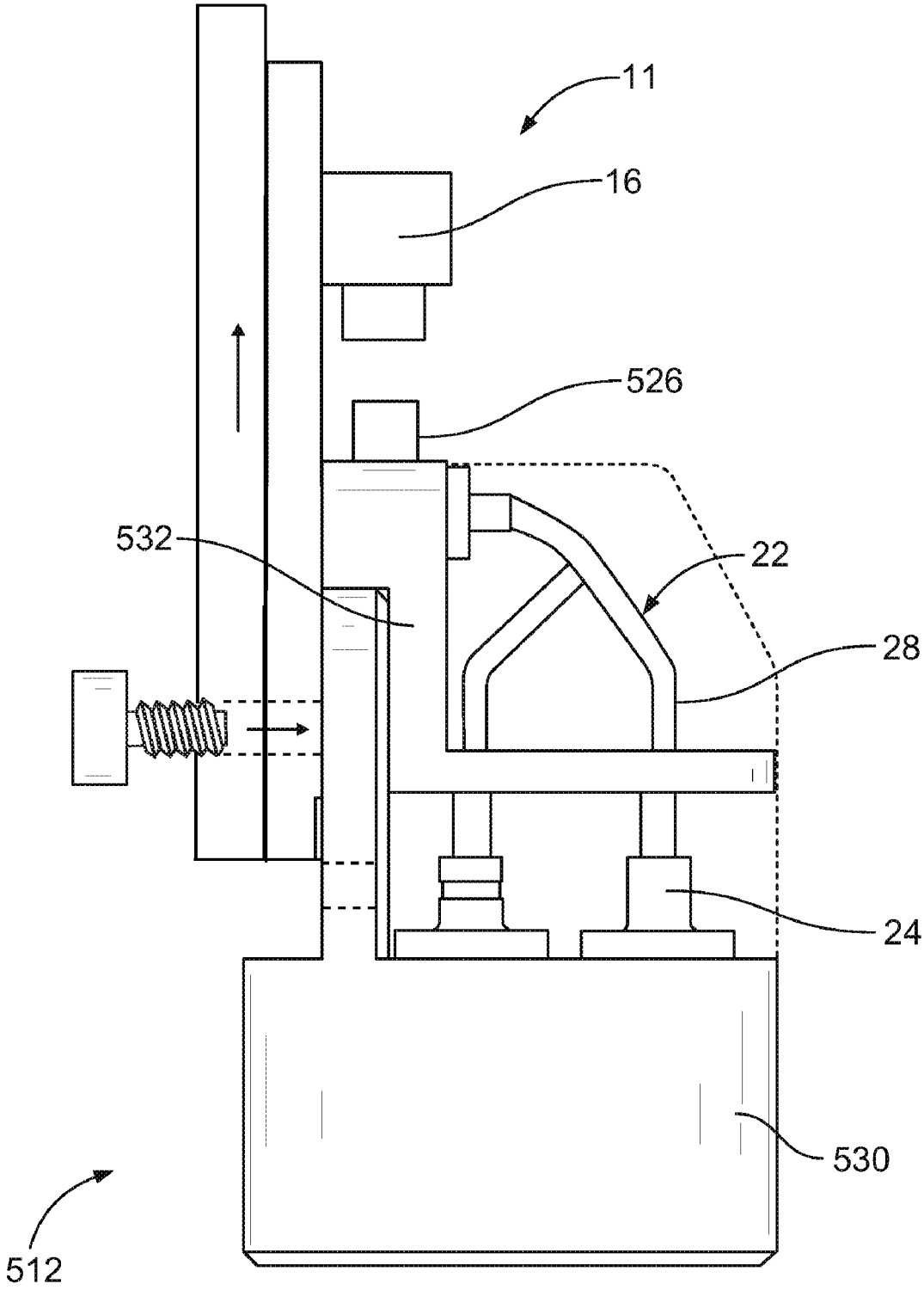
FIG. 16 is a side view of another alternative RF module.

FIG. 16 is a side view of another alternative RF module 512 that may be used to interconnect the backplane module 11 and the daughtercard module 13 (both shown in FIG. 1). The RF module 512 includes a front housing 530 that may be substantially similar to the front housing 30 (shown in FIG. 1). The RF module 512 holds a plurality of the cable assemblies 22. The front housing 530 holds the front end connectors 24 and a connector holder 532 holds rear end connectors 526. The rear end connectors 526 are right angle coaxial connectors, as opposed to the straight coaxial connectors shown in FIG. 4.

Figure 17:
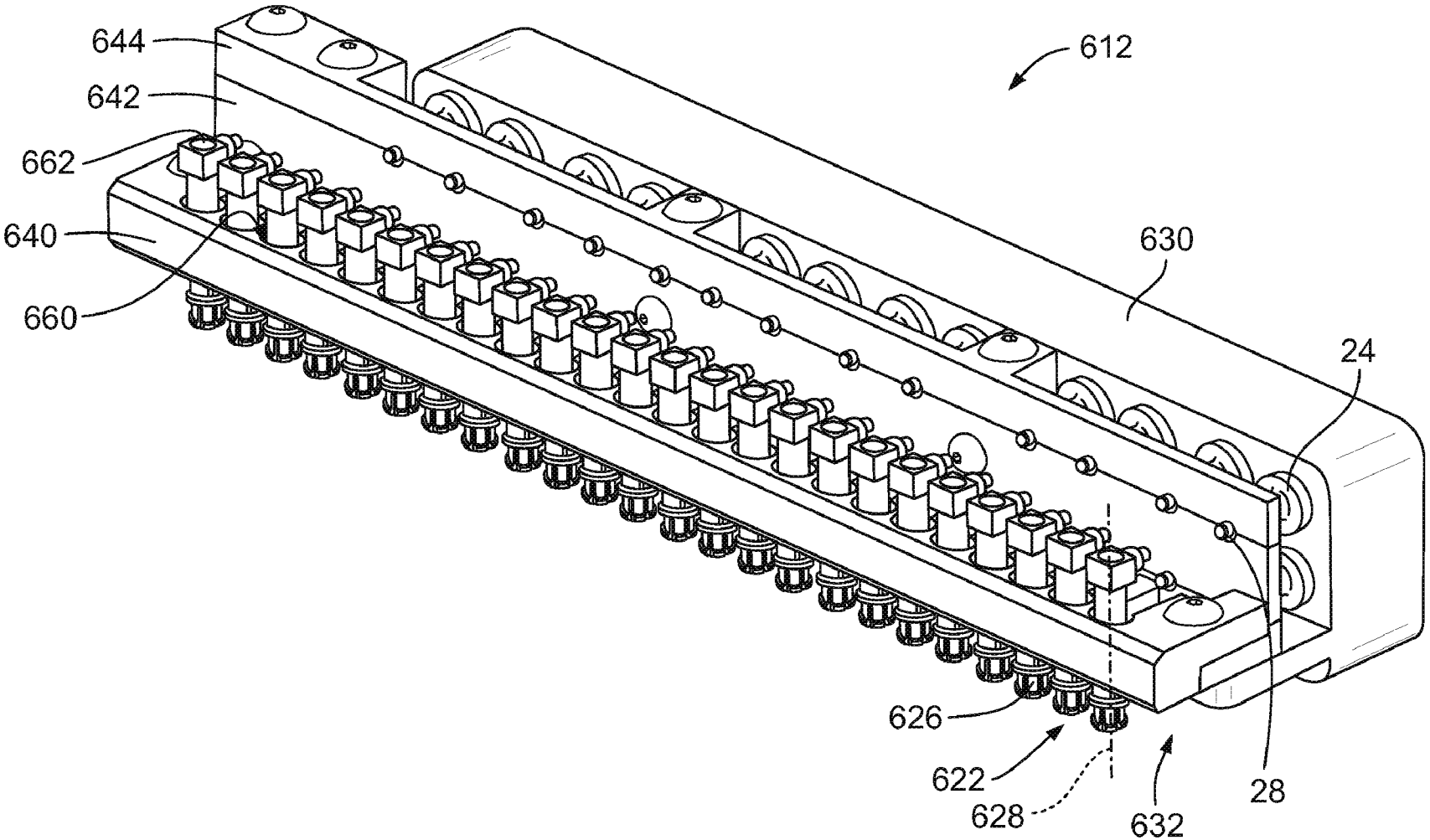
FIG. 17 is a rear perspective view of an alternative RF module.

The connector holder 532 orients the rear end connectors 526 for gang loading the rear end connectors 526 into the board connectors 16 (shown in FIG. 1) during assembly. The connector holder 532 also holds the cables 28 and may provide strain relief FIG. 17 is a rear perspective view of an alternative RF module 612 that may be used to interconnect the backplane module 11 and the daughtercard module 13 (both shown in FIG. 1). The RF module 612 includes a front housing 630 that may be substantially similar to the front housing 30 (shown in FIG. 1). The RF module 612 holds a plurality of cable assemblies 622, wherein portions of the cables 28 of the cable assemblies 622 have been removed for clarity. The front housing 630 holds the front end connectors 24 and a connector holder 632 holds rear end connectors 626. The rear end connectors 626 are right angle coaxial connectors. The rear end connectors 626 generally extend along a longitudinal axis 628 and the cable 28 extends into the rear end connector 626 from a direction perpendicular to the longitudinal axis 628.

The connector holder 632 orients the rear end connectors 626 for gang loading the rear end connectors 626 into the board connectors 16 (shown in FIG. 1) during assembly. In the illustrated embodiment, the connector holder 632 orients the rear end connectors 626 generally perpendicular to the front end connectors 24. For example, if the front end connectors 24 are oriented horizontally then the rear end connectors 626 are oriented generally vertically. Other orientations are possible in alternative embodiments.

The connector holder 632 includes a base holder 640, a central plate 642 and a top cover 644. The base holder 640, central plate 642 and top cover 644 may be similar to the base holder 140, central plate 142 and top cover 144 (shown in FIG. 3). The base holder 640 is mounted to the front housing 630 and includes bores 660 that receive and hold the rear end connectors 626. Optionally, the rear end connectors 626 may be held in the bores 660 without any springs. The rear end connectors 626 may be initially gang loaded into the board connectors (shown in FIG. 1) and then snapped into final positions using a hand tool (not shown) or by pressing down on a top surface 662 of the rear end connectors 626, such as by using a thumb.

Figure 18:
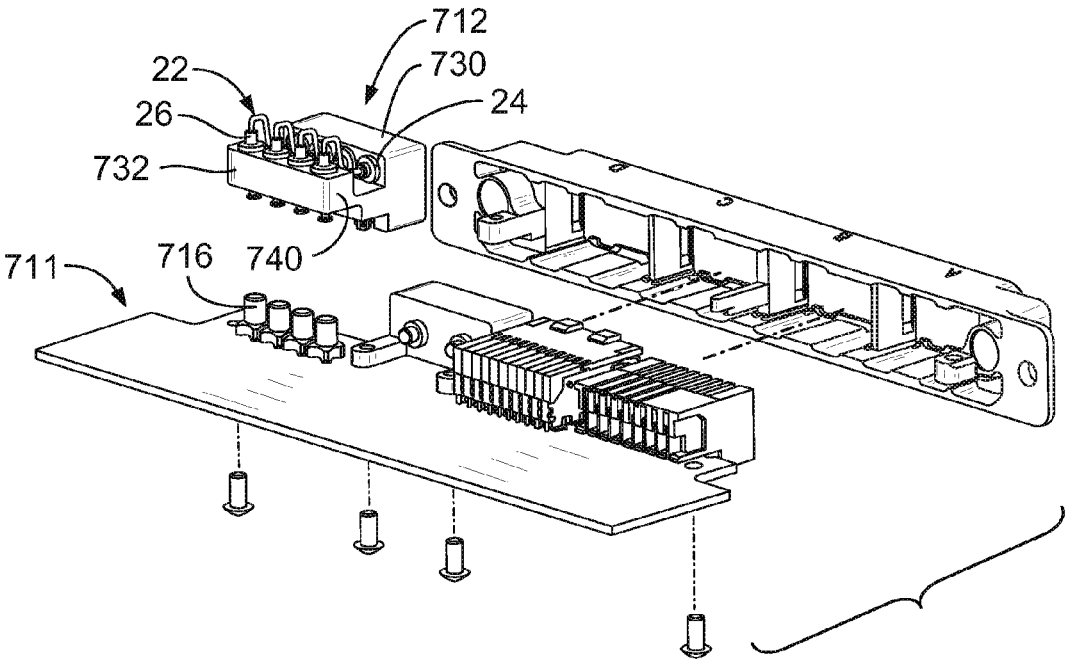
FIG. 18 is a rear perspective view of an alternative RF module.

FIG. 18 is a rear perspective view of an alternative RF module 712 that may be used to interconnect a backplane module 711 and the daughtercard module 13 (shown in FIG. 1). The RF module 712 includes a front housing 730 that may be substantially similar to the front housing 30 (shown in FIG. 1). The RF module 712 holds a plurality of the cable assemblies 22. The front housing 730 holds the front end connectors 24 and a connector holder 732 holds the rear end connectors 26.

The connector holder 732 orients the rear end connectors 26 for gang loading the rear end connectors 26 into board connectors 716 of the backplane module 711 during assembly. In the illustrated embodiment, the connector holder 732 orients the rear end connectors 26 generally perpendicular to the front end connectors 24. For example, if the front end connectors 24 are oriented horizontally then the rear end connectors 26 are oriented generally vertically. Other orientations are possible in alternative embodiments.

In the illustrated embodiment, the connector holder 732 is formed integral with the front housing 730. The connector holder 732 includes a base holder 740 that has bores 760 that receive and hold the rear end connectors 26. Optionally, the rear end connectors 26 may be held in the bores 760 (shown in FIG. 19) without any springs. The rear end connectors 26 may be initially gang loaded into the board connectors 716 and then snapped into final positions using the hand tool (not shown). Alternatively, the rear end connectors 26 may be pressed into the board connectors 716 and held in contact therewith using springs.

Figure 19:
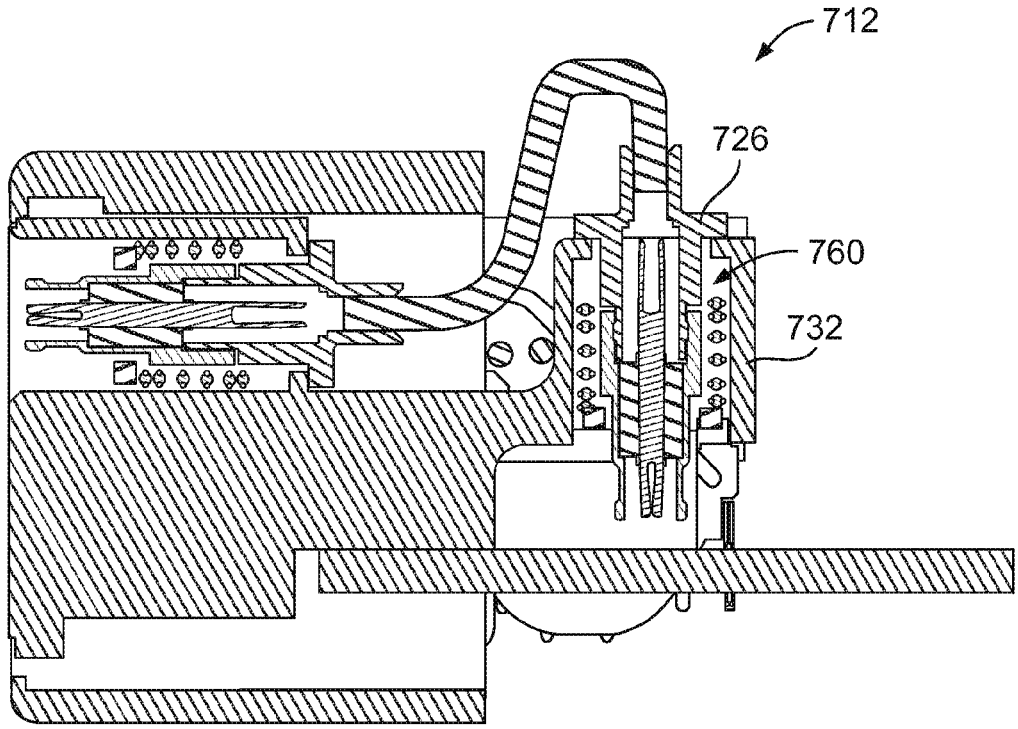
FIG. 19 is a cross-sectional view of the RF module shown in FIG. 18.

FIG. 19 is a cross-sectional view of the RF module 712 showing the rear end connectors 26 held in the connector holder 732.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An radio-frequency (RF) module configured to be coupled to a backplane module, the RF module comprising:

a front housing having walls defining connector cavities, the walls comprising a rear wall having a plurality of openings therethrough, the connector cavities being open opposite the rear wall to receive electrical connectors;

RF cable assemblies having front end connectors and rear end connectors connected by corresponding cables, the front and rear end connectors being coaxial connectors, the front end connectors received in corresponding connector cavities through corresponding openings; and a connector holder extending from the front housing rearward of the rear wall, the connector holder holding the rear end connectors such that the rear end connectors are simultaneously pluggable into corresponding board connectors of the backplane module;

wherein the front end connectors are arranged in multiple rows, and wherein the rear end connectors are arranged in a single row.

2. The RF module of claim 1, wherein the rear end connectors are moveable with respect to the connector holder along central longitudinal axes of the rear end connectors.

3. The RF module of claim 1, wherein the rear end connectors have mating ends, the connector holder holding the mating ends coplanar such that the mating ends may be simultaneously loaded into the board connectors.

4. The RF module of claim 1, wherein the rear end connectors include springs engaging the connector holder and preloading the rear end connectors for loading into the board connectors, the rear end connectors being spring biased against the board connectors to ensure electrical connection with the board connectors.

5. The RF module of claim 1, wherein each of the cables have substantially equal lengths between the front end connectors and the rear end connectors.

6. The RF module of claim 1, wherein the front housing includes a base extending rearward from the rear wall, the connector holder being coupled to the base, the rear end connectors being held between the base and the connector holder.

7. The RF module of claim 1, wherein the connector holder includes cylindrical bores that receive the rear end connectors such that mating ends of the rear end connectors extend from the connector holder for gang loading into the board connectors, the rear end connectors being either all simultaneously pressed into the board connectors to mated positions or individually pressed into the board connectors from the gang loaded position to a mated position using a hand or a hand tool.

8. The RF module of claim 1, wherein the connector holder includes cylindrical bores that receive the rear end connectors, the connector holder having cable slots along a top of a the corresponding bore and open to the corresponding bore, the cables extending into the bores through the cable slots, the cables being moveable within the cable slots.

9. The RF module of claim 1, wherein the connector holder includes pockets aligned with the openings, the pockets receive the cables and provide strain relief for the cables.

10. The RF module of claim 1, wherein the front end connectors are held by the front housing in a lower row and an upper row, the connector holder includes a base holder having pockets aligned with the openings associated with the lower row, the connector holder includes a central plate having a top and a bottom, the central plate having pockets in the top aligned with the openings associated with the upper row and the central plate having pockets in the bottom aligned with the openings associated with the lower row, the connector holder includes a top cover having pockets aligned with the openings associated with the upper row, the cables extending between the connector holder and the front housing along parallel longitudinal axes.

11. The RF module of claim 1, wherein front electrical connectors are held within the front housing along parallel central longitudinal axes, the rear end connectors being held by the connector holder along parallel central longitudinal axes, the rear end connectors being oriented one of parallel to the front end connectors or perpendicular to the front end connectors.

12. An radio-frequency (RF) module configured to be coupled to a backplane module, the RF module comprising:

a front housing having a plurality of connector cavities and a rear wall having a plurality of openings therethrough to corresponding connector cavities, the front housing having a base extending rearward from the rear wall;

RF cable assemblies having front end connectors and rear end connectors connected by corresponding cables, the front and rear end connectors being coaxial connectors, the front end connectors received in corresponding connector cavities through corresponding openings, the rear end connectors having cable ends and mating ends with a flange therebetween; and a connector holder separately provided from, and coupled to, the base, the connector holder having a plurality of cylindrical bores that receive the cable ends of the rear end connectors, the mating ends of the rear end connectors extending rearward from the connector holders such that the mating ends of the rear end connectors are configured to be gang loaded into corresponding board connectors of the backplane module;

wherein the front end connectors are arranged in multiple rows, and wherein the rear end connectors are arranged in a single row.

13. The RF module of claim 12, wherein the rear end connectors are moveable with respect to the connector holder along central longitudinal axes of the rear end connectors.

14. The RF module of claim 12, wherein the connector holder holds the mating ends coplanar such that the mating ends may be simultaneously loaded into the board connectors.

15. The RF module of claim 12, wherein the rear end connectors include springs engaging the connector holder and preloading the rear end connectors for loading into the board connectors, the rear end connectors being spring biased against the board connectors to ensure electrical connection with the board connectors.

16. The RF module of claim 12, wherein the connector holder includes cylindrical bores that receive the rear end connectors, the connector holder having cable slots along a top of a the corresponding bore and open to the corresponding bore, the cables extending into the bores through the cable slots, the cables being moveable within the cable slots.

17. A board connector system comprising:

a backplane module comprising a flame, a backplane circuit board held by the frame, and a plurality of board connectors terminated to the backplane circuit board;

a daughter card module comprising a housing and a plurality of electrical connectors held by the housing, the electrical connectors being one of board mounted connectors or cable mounted connectors; and an radio-frequency (RF) module coupled to the frame and interconnecting the board connectors of the backplane module with corresponding electrical connectors of the daughter card module, the RF module comprising RF cable assemblies having front end connectors and rear end connectors connected by corresponding cables, the front and rear end connectors being coaxial connectors, the front end connectors being connected to corresponding electrical connectors of the daughter card module, the rear end connectors being connected to corresponding board connectors of the backplane module, the RF module further comprising a front housing having a plurality of connector cavities that receive and hold corresponding front end connectors, and the RF module further comprising a connector holder having a plurality of cylindrical bores that receive the rear end connectors, the rear end connectors extending rearward [from] beyond the connector holder such that the rear end connectors are configured to be gang loaded into corresponding board connectors of the backplane module.

18. The board connector system of claim 17, wherein the connector holder holds the rear end connectors such that the rear end connectors are simultaneously pluggable into corresponding board connectors of the backplane module.

* * * * *